United States Patent [19]

Pribyl

[11] Patent Number: 4,790,021

[45] Date of Patent: Dec. 6, 1988

[54] ELECTROSTATIC TRANSDUCER

[75] Inventor: Richard Pribyl, Vienna, Austria

[73] Assignee: AKG Akustische u. Kino-Geräte Gesellschaft m.b.H., Vienna, Austria

[21] Appl. No.: 71,013

[22] Filed: Jul. 8, 1987

[30] Foreign Application Priority Data

Jul. 24, 1986 [AT] Austria ..... 2009/86

[51] Int. Cl.[4] ..... H04R 19/04

[52] U.S. Cl. ..... 381/191; 181/171; 381/205; 381/113

[58] Field of Search ..... 181/158, 160, 171; 381/191, 193, 159, 205, 187, 188, 113, 155

[56] References Cited

U.S. PATENT DOCUMENTS 4,302,633 11/1981 Tamamura et al. ..... 381/191 X
4,429,193 1/1984 Busch-Vishniac et al. .... 381/191 X
4,434,327 2/1984 Busch-Vishniac et al. .... 381/191 X
4,621,171 11/1986 Wada et al. ..... 381/113

FOREIGN PATENT DOCUMENTS 0203400 12/1982 Japan ..... 181/171

*Primary Examiner*—L. T. Hix
*Assistant Examiner*—Brian W. Brown
*Attorney, Agent, or Firm*—Toren, McGeady & Associates

[57] ABSTRACT

An electrostatic transducer with a diaphragm supported by means of a stretching ring, and a back plate which is formed by a thin metal plate supported on a carrier member and mounted spaced apart from the diaphragm. A plurality of support members are attached to the carrier member and distributed over the area of the carrier member. The base plate is glued to the free ends of the support members. In this transducer, the use of very thin metal plate as back plates is possible.

7 Claims, 1 Drawing Sheet

ELECTROSTATIC TRANSDUCER

BACKGROUND OF THE INVENTION

1. Field of the Invention

The present invention relates to an electrostatic transducer with a diaphragm supported by means of a stretching or clamping ring, and a back plate which is formed by a thin metal plate supported on a carrier member and mounted spaced apart from the diaphragm. The invention further relates to a method of manufacturing an electrostatic transducer and to a device for carrying out this method.

2. Description of the Prior Art

German Offenlegungsschrift No. 33 25 966 describes an electrostatic transducer whose back plate is constructed as a thin plate. In the assembled state of such a transducer composed of diaphragm, diaphragm support ring, spacer ring and back plate, a pressure is generally exerted on the back plate by means of a spring. In this type of arrangement, the back plate must be sufficiently stiff, so that the pressure of the spring does not twist or bend the back plate. Thus, the plate used as the back plate must have a certain minimum thickness. Any waviness present in the plate must be eliminated by a planing process prior to the assembly of the transducer.

In an electrostatic transducer of the above-described type, a plane parallel spacing of approximately 50 μm must exist between the back plate and the diaphragm surface. Therefore, the planeness of the back plate must meet the highest requirements. These requirements can only be met by using a complicated manufacturing process for the back plate and by providing the back plate with the appropriate stiffness. It may be necessary for acoustic reasons to provide the back plate with holes. This results in an additional weakening of the material of the back plates.

Austrian patent No. 323,257 and U.S. Pat. Nos. 4,429,193 and 4,434,327 disclose electrostatic transducers with support and stop elements. However, as in the transducer described above, these transducers have a solid base plate which is provided with support elements for supporting the diaphragm of the transducer. As shown in Austrian patent No. 322,257, the support elements may be lower than the distance between diaphragm and the base plate, so that sufficient space is provided during normal acoustic irradiation of the microphone to permit the diaphragm to vibrate unimpeded, while contact of the diaphragm with the back plate is prevented during the occurrence of extremely high sound pressures.

German Offenlegungsschrift No. 31 07 282 shows that the back plate of an electrostatic transducer can also consist of a metal surface applied onto an oscillating plate. A plurality of through openings in this insulating plate ensure that the sound permeability of the plate is sufficient. In this case, the insulating plate is a carrier for the metal surface acting as an electrode, wherein the carrier is connected to the electrode over the entire electrode surface.

An electrostatic sound transducer described in European publication No. 140,143 could be considered similar to the transducer according to the present invention as far as the external arrangement is concerned. However, this similarity does not actually exist because, in the prior art sound transducer, the diaphragm which is irradiated with sound consists of a stretchable plastics material foil with electrically conductive particles placed in the foil. This plastics material foil is mounted between two surface electrodes which are provided with holes and coated with an electrically insulating sintered material having a puncture strength of more than 3 KV.

It is, therefore, the object of the present invention to avoid the disadvantages which usually occur when a thin metal plate is used as the base plate. The invention is to make possible that metal plates can be used which have a minimum thickness of less than 0.1 mm without negatively influencing the plane parallelism between diaphragm and base plate.

SUMMARY OF THE INVENTION

In accordance with the present invention, an electrostatic transducer of the aforedescribed type includes a plurality of support members attached to the carrier member distributed over the area of the carrier member, wherein the base plate is glued to the free ends of the support members.

The support of the base plate on the carrier member ensures that the base plate is substantially more plane than it would be without this support. This is because a plane shape of the base plate is obtained by fixing the base plate in the points where the base plate is glued. Another advantage resides in the possibility of using very thin metal plates as base plates for electrostatic transducers. The planeness of the base plates is determined by the plunger or die used in the manufacturing process of the base plate.

Since the base plate is glued on under high pressure, the planeness of the surface of the glued base plate can be obtained within a few μm. The surface of the carrier member, on the other hand, may be relatively rough and wavy, so that the adhesive can be distributed evenly over the surface to be glued and the residues of the adhesive can enter the indentations in the carrier member surface.

Base plates which have been used in the past had a surface waviness of up to 30 μm, unless they were subjected to a subsequent planing process.

The stiffness of the base plate after being glued on is practically equivalent to the stiffness of the base plate carrier. The latter can be selected in such a way that no bending can occur in the electrostatic transducer in the assembled state.

In accordance with an advantageous further development of the invention, the carrier member for the base plate is constructed as a cup-shaped member and has a plurality of symmetrically arranged, preferably cylindrical support members, the end faces of which extend in one plane with the edge of the cup-shaped member. This shape of the carrier member of the base plate is advantageous in those cases where the base plate must have holes for acoustic reasons, i.e., as they are particularly required for pressure-gradient sound pickups.

The holes are arranged in the base plate in such a way that they are located exactly between the circular support surfaces or end faces of the cylindrical support members of the carrier member. As a result, an acoustic connection is ensured between the low coupling space behind the diaphragm and additional acoustic elements arranged behind the base plate. In addition, a path is provided for the sound into the area surrouuding the electrostatic transducer.

The cylindrical support members on which the base plate is glued provide the additional advantage that the cup-shaped structure of the carrier member is divided, so that the occurrence of vibration modes are prevented in the remaining volume. As a result, unwanted reactive effects on the vibration state of the diaphragm are avoided in the case of higher frequencies in the audible range and above. The edge of the cup-shaped member and the cylindrical end faces of the support members which are located within one plane, offer a sufficiently large surface area for gluing on the base plate.

In accordance with another embodiment of the invention, the plurality of cylindrical support members are non-symmetrically arranged. An arrangement of the individual holes in the base plate which is not symmetrical may be of particular advantage for specific acoustic applications.

In accordance with another feature of the invention, the cup-shaped carrier member may be closed off with a base plate which is provided with circular bores near its periphery. These bores lead from the interior of the cup-shaped member and are provided with an acoustic frictional resistance. The total volume enclosed within the cup-shaped member may form together with the acoustic frictional resistance provided in the bottom of the cup, an acoustic phase-shifting section as it is required for acoustic transducers with pickup effect.

In accordance with an advantageous further development of the invention, the cup-shaped carrier member for the base plate is a single-piece molded member of electrically conductive plastics material or of electrically conductive ceramic sintered material. The molded carrier member is manufactured by an injection molding process. As a result, the carrier member is compact and has high mechanical strength. Since the material of the carrier member is electrically conductive, the structure of the entire electrostatic transducer is simple because complicated electrical connections with the metal base plate and other electrically conductive parts of the transducer are not necessary.

In accordance with the present invention, the method of manufacturing the electrostatic transducer includes gluing the initially wavy base plate under high pressure against the end face of the carrier member, so that the surface of the plate is simultaneously rendered plane. Since the wavy base plate is pressed on under high pressure and over a large surface area, the method according to the invention ensures that the base plate is plane when mounted. The glued connections ensure that the base plate remains fixed in its position A device for carrying out the above-described method includes a tubular member whose inner diameter corresponds to the outer diameter of the base plate. In the tubular member are mounted two plungers which can be moved relative to each other. The first plunger has a large plane front surface and acts as a pressure member for the metal plate. The second plunger may have a smaller pressure surface and forms the member for absorbing the pressure acting on the carrier member. Preferably, the second plunger is lockable. The simple device according to the invention makes it possible without problems to apply pressure over the surface area of the plate. The second plunger supports the carrier member. The members to be glued cannot slide to the side during gluing.

The various features of novelty which characterize the invention are pointed out with particularity in the claims annexed to and forming a part of this disclosure. For a better understandig of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
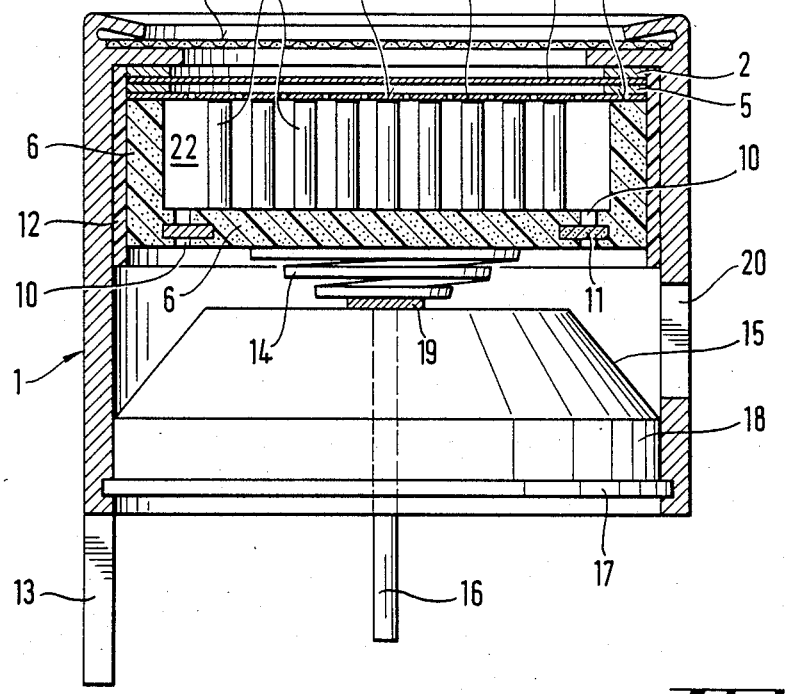
FIG. 1 is a schematic sectional view of an electrostatic transducer according to the invention.

As illustrated in FIG. 1 of the drawing, the electrostatic transducer according to the present invention includes a metal housing 1 in which the diaphragm 3 held by a stretching ring 2 is mounted so as to extend parallel to a base plate 4. A spacer ring 5 of electrically insulating material serves to hold diaphragm 3 spaced apart from base plate 4. A cylindrical cup-shaped member 6 serves as the carrier member for the base plate 4. Cup-shaped member 6 is made of electrically conductive plastics material or a sintered ceramic material with a conductive coating. In the interior of the cup-shaped member 6 are provided a plurality of preferably cylindrical support members 7. The end faces 8 of support members 7 are located in the same plane as the edge 9 of cup-shaped member 6.

The bottom of the cup-shaped member 6 defines bores 10 which are arranged in a circular fashion and are provided with acoustic friction elements 11. Each acoustic friction element 11 is constructed as a ring which is mounted by injection molding together with the cup-shaped member 6. Since cup-shaped member 6 is electrically conductive, it is insulated by means of an electrically insulating foil 12 relative to the metal housing 1. Foil 12 may be, for example, of teflon. Metal housing 1 effects the conductive connection to the diaphragm 3 and, for effecting contact with a stranded wire, has a contact member 13.

The back plate 4 is provided with bores which are arranged between the end faces 8 of the cylindrical support member 7. The back plate 4 is fastened by gluing in an electrically conductive manner on edge 7 of cup-shaped member 6 as well as on the end faces 8 of the cylindrical support members 7. Accordingly, the base plate 4 may be of a very thin sheet metal with a thickness of only a few tenths of a millimeter. Even though the back plate 4 is very thin, it is not subject to bulging in the assembled state and does not begin to vibrate during sound irradiation due to its properties as a diaphragm.

The cup-shaped member 6 and the back plate 4 glued to the cup-shaped member 6 are pressed against spacer ring 5 and stretching ring 2 by means of a conically-shaped helical spring 14 which is supported on a truncated cone 15. Stretching ring 2 rests on an annular shoulder provided for this purpose in housing 1. Thus, the entire arrangement is securely mounted.

A contact pin 16 extends through a base plate 17 and a structural block member 18 for electronic components and through cone 15 to a contact plate 19 and, thus, effects the electrical connection of the base plate 4 to the outside. Cone 15 has sound conductive properties, so that the sound pressure present at the sound entry opening 20 can be conducted to the rear side of the diaphragm in an acoustically more advantageous manner. An impedance transformer and, if necessary, other electronic structural units in miniaturized form are accommodated in structural block member 18.

The entire arrangement is closed off toward the rear by means of base plate 17 or a spring ring provided in place of base plate 17. At the front side of the arrangement is provided a perforated plate or a fine mesh disk 21 for the mechanical protection of the arrangement and for protecting the diaphragm 3 against dust. Together with the space 22 within the cup-shaped member 6, the acoustic frictional elements 11 mounted in bores 10 form an acoustic phase-shifting section, as it is required for a transducer having a unilateral pickup effect.

Figure 2:
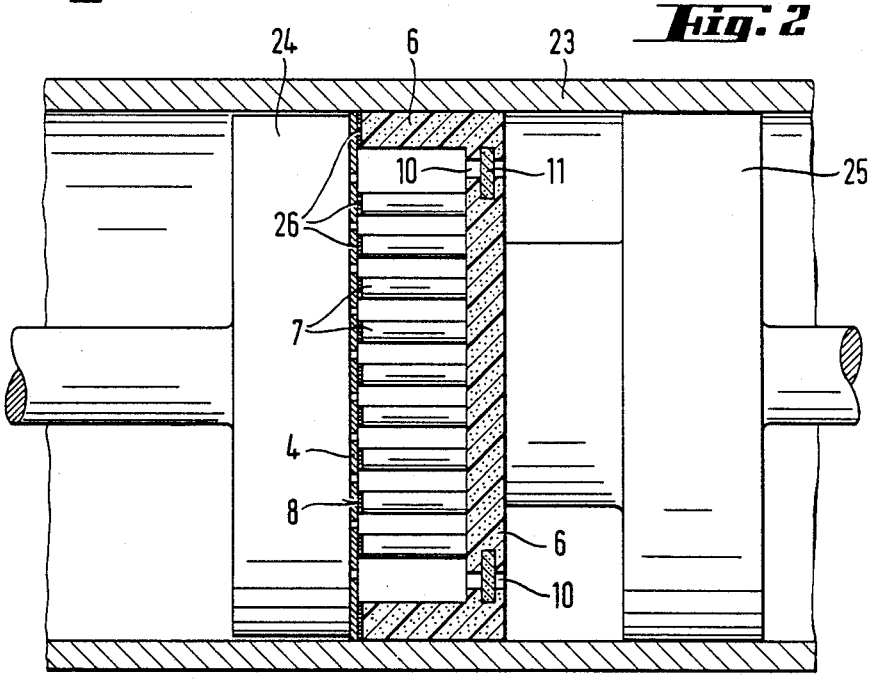
FIG. 2 is a schematic transverse cross-sectional view of the device used in manufacturing the electrostatic transducer according to the invention.

FIG. 2 of the drawing shows a device used in the manufacture of the electrostatic transducer according to the present invention. The carrier member 6 is guided in a tube 23. A plunger 25 holds the carrier member 6 fixed in its position and, thus, prevents its axial movement. A layer of adhesive 26 is provided on the surfaces of the carrier member 6 which are to be connected with base plate 4. Base plate 4 is then pressed under high pressure by means of a plunger 24 against the adhesive layer 26. As a result, an excellent planeness of the base plate 4 is achieved which, due to the glued connection, remains even after plunger 24 has been released from base plate 4. The glued connection further ensures that the base plate assumes the stiffness of the carrier 6.

While a specific embodiment of the invention has been shown and described in detail to illustrate the application of the inventive principles, it will be understood that the invention may be embodied otherwise without departing from such principles.

I claim:

1. An electrostatic transducer, comprising a diaphragm, a stretching ring supporting the diaphragm, a back plate mounted spaced apart from the diaphragm, the back plate composed of a thin metal plate, a carrier member carrying the back plate, a plurality of support members attached to the carrier member and distributed over the area of the carrier member, the support members having free ends facing away from the carrier member, the back plate being glued to the free ends of the support members.

2. The transducer according to claim 1, wherein the carrier member is cup-shaped and defines a circumferentially extending edge, the support members being arranged symmetrically and the end faces of the support members being located in the same plane as the circumferentially extending edge.

3. The transducer according to claim 2, wherein the support members are cylindrical.

4. The transducer according to claim 2, wherein the cup-shaped carrier member includes a base plate, the base plate defining bores for connecting the interior of the carrier member with the outside, the bores being arranged in a circular fashion near the periphery of the base plate, wherein acoustic friction elements are mounted in the bores.

5. The transducer according to claim 2, wherein the cup-shaped carrier member is a one-piece molded member.

6. The transducer according to claim 5, wherein the carrier member is of electrically conductive plastics material.

7. The transducer according to claim 5, wherein the carrier member is of an electrically conductive ceramic sintered material.

* * * * *